United States Patent [19]

Roberts

[11] 4,293,792

[45] Oct. 6, 1981

[54] COLOR PICTURE TUBE HAVING IMPROVED SLIT TYPE SHADOW MASK

[75] Inventor: Donald L. Roberts, Conestoga, Pa.

[73] Assignee: RCA Corporation, New York, N.Y.

[21] Appl. No.: 104,828

[22] Filed: Dec. 18, 1979

[51] Int. Cl.[3] ..... H01J 29/07; H01J 29/18

[52] U.S. Cl. ..... 313/403; 313/408

[58] Field of Search ..... 313/403, 408

[56] References Cited

U.S. PATENT DOCUMENTS

| | | | |
|---|---|---|---|
| 3,882,347 | 5/1975 | Suzuki et al. | 313/403 |
| 3,883,770 | 5/1975 | Yamada et al. | 313/403 |
| 3,916,243 | 10/1975 | Brown | 313/403 |
| 3,944,867 | 3/1976 | Kaplan | 313/403 |
| 4,048,536 | 9/1977 | Brown | 313/403 |

*Primary Examiner*—Palmer C. Demeo

*Attorney, Agent, or Firm*—Eugene M. Whitacre; Glenn H. Bruestle; Dennis H. Irlbeck

[57] ABSTRACT

A color picture tube having a cathodoluminescent screen, electron gun and a slit type apertured mask located between the screen and gun, wherein the slits in such mask are arranged in columns and the slits in each column are separated by webs, has an improved web configuration. Alternate webs within a column are of lesser thickness than the general mask thickness with the geometric center of the alternate webs being offset toward the screen side of the mask.

4 Claims, 7 Drawing Figures

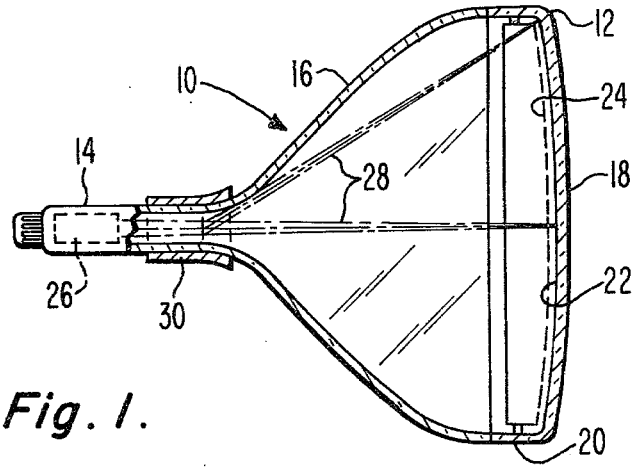
Fig. 1.
Fig. 2.
PRIOR ART
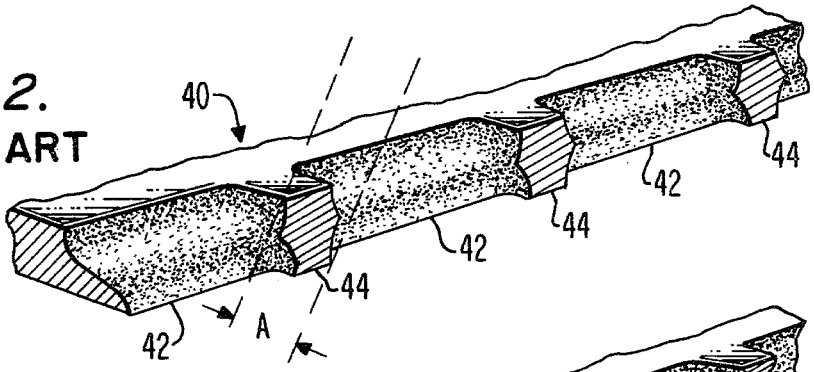
Fig. 3.
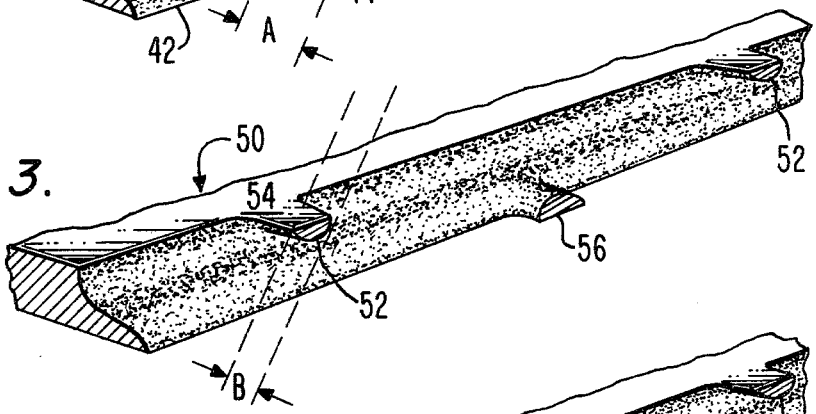
Fig. 4.
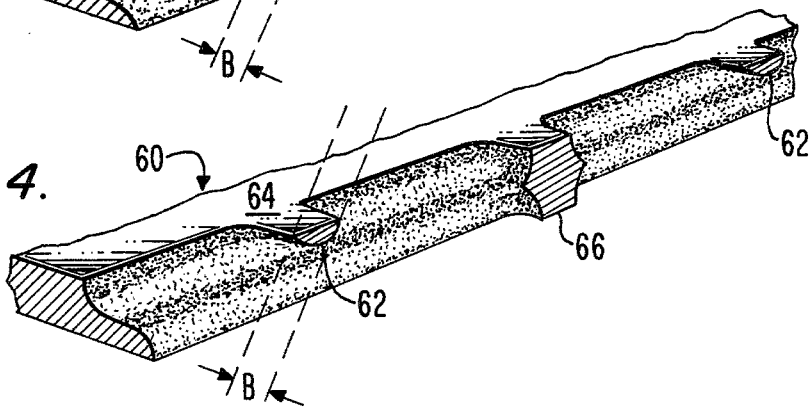

COLOR PICTURE TUBE HAVING IMPROVED SLIT TYPE SHADOW MASK

BACKGROUND OF THE INVENTION

This invention relates to color picture tubes and particularly to such tubes having a slit type apertured mask.

Shadow mask type color picture tubes usually include a screen of red, green and blue emitting phosphor lines or dots, electron gun means for exciting the screen and a shadow mask interposed between the gun means and the screen. The shadow mask is a thin multiapertured sheet of metal precisely disposed adjacent the screen so that the mask or apertures are systematically related to the phosphor lines or dots.

Color picture tubes having shadow masks with slit shaped apertures have received relatively recent commercial acceptance. One of the reasons for this acceptance is that the percentage of electron beam transmission through the mask can be made higher for a slit mask-line screen type of tube than for a circular apertured mask-dot screen type tube. Even though the use of a slit mask provides a definite advantage in electron beam transmission, the percentage of electron beam transmission through a slit mask can be increased even further than is practiced in the present art.

Two types of slit shadow masks are in present use. In one type, the slits extend continuously from the top to the bottom of the mask. Such configuration is only used in a cylindrically shaped mask and requires a massive rigid frame to hold the mask taut. In another type slit shadow mask, the mask is domed so that it is curved both vertically and horizontally. In this mask embodiment, the vertically extending slits are interrupted by a plurality of spaced bridges or webs to aid in maintaining the domed shape. The presence of these webs, however, reduces electron beam transmission and thereby reduces the amount of tube brightness compared to a tube having no webs. It is therefore desirable to develop a mask wherein the effect of the webs on electron beam transmission is reduced.

SUMMARY OF THE INVENTION

A color picture tube having a cathodoluminescent screen, an electron gun, and a slit type apertured mask located between the screen and gun, wherein the slits in such mask are arranged in columns and the slits in each column are separated by webs. Alternate webs within a column are of lesser thickness than the general mask thickness with the geometric center of the alternate webs being offset toward the screen side of the mask.

BRIEF DESCRIPTION OF THE DRAWINGS

FIG. 1 is a plan view, partly in axial section, of a shadow mask type color picture tube.

FIGS. 2, 3 and 4 are cut-away perspective views of a prior art mask and two improved masks, respectively, showing the cross-sectional shapes of the masks' webs.

DETAILED DESCRIPTION OF THE PREFERRED EMBODIMENTS

Figure 5:
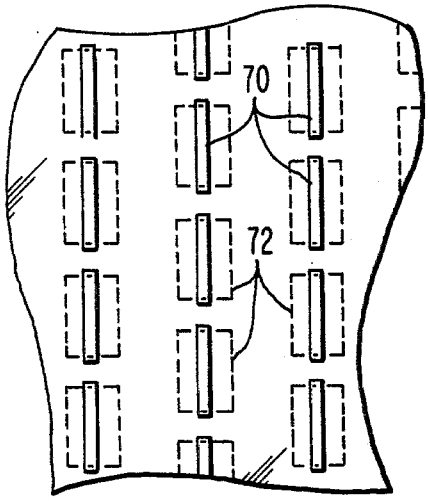
Fig. 5. PRIOR ART
FIGS. 5, 6 and 7 are portions of photomaster patterns used in making the masks of FIGS. 2, 3 and 4, respectively.

FIG. 1 illustrates a rectangular color picture tube having a glass envelope 10 comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A mosaic three-color phosphor screen 22 is carried by the inner surface of the faceplate 18. The screen is a line screen with the phosphor lines extending substantially parallel to the central vertical axis of the tube (normal to the plane of FIG. 1). An improved novel multi-apertured color selection electrode or shadow mask 24 is removably mounted, by conventional means, in predetermined space relation to the screen 22. An inline electron gun 26, shown schematically by dotted lines in FIG. 1, is centrally mounted within the neck 14 to generate and direct three electron beams 28 along coplanar convergent paths through the mask 24 to the screen 22. The The mask 24 serves a color selection function by screening each electron beam from the nonassociated color emitting phosphor lines while permitting them to strike their associated lines. A magnetic deflection yoke 30 is positioned on the envelope 10 near the intersection of the funnel 16 and the neck 14. When suitably energized, the yoke 30 causes the electron beams 28 to scan the screen 22 in a rectangular raster.

FIG. 2 shows a small portion of a prior art shadow mask sectioned along the middle of an aperture column. The apertures 42 within the column are separated from each other by bridge portions 44 of mask, usually called tie-bars or webs. The webs 44 in this particular prior art mask have a hexagonal-shaped cross-section. The webs in another type of prior art mask have a somewhat triangular-shaped cross-section. All of the webs 44 are the full thickness of the mask 40. Because the webs 44 are full thickness a large portion "A" of an electron beam incident upon the mask 40 will be intercepted by the webs 44. It is desirable to reduce the amount of an electron beam intercepted by the webs in a mask thereby increasing mask transmission and light output. However, it also is desirable to minimize any compromise that must be made in mask strength to obtain this greater transmission.

Two mask embodiments 50 and 60 of the novel improved mask 24 that provide increased mask transmission while minimizing the reduction in mask strength are shown in FIGS. 3 and 4, respectively. In both of these embodiments, alternate webs are of reduced thickness relative to the general mask thickness, with the geometric center of the alternate webs being offset toward the screen side of the mask. The mask 50 of FIG. 3 has alternate webs 52 of reduced thickness offset toward the screen side 54 of the mask and the remaining webs 56 also of reduced thickness are offset toward the opposite or gun side of the mask. The mask 60 of FIG. 4 has alternate webs 62 of reduced thickness offset toward the screen side 64 of the mask but the remaining webs 66 are of full mask thickness. The increased electron beam transmission can be seen by comparing the decreased portion "B" of an electron beam intercepted by the webs 56 and 66 in FIGS. 3 and 4 with the portion "A" in FIG. 2.

Figure 6:
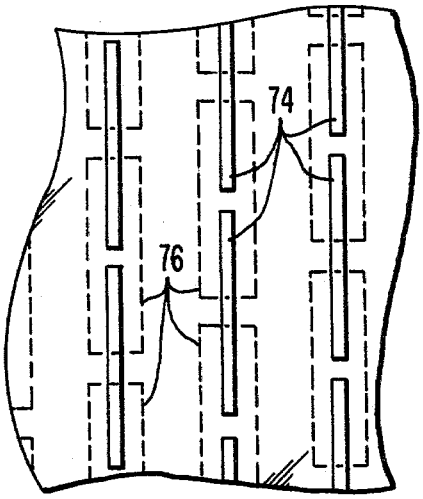
Figure 7:
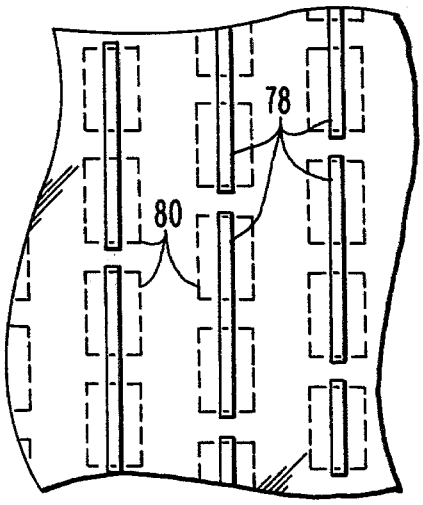

FIGS. 5, 6 and 7 show the photomaster patterns used to form the masks of FIGS. 2, 3 and 4, respectively. In each drawing the solid line pattern is for the gun side of the mask and the dashed pattern is for the screen side of the mask. In the prior art patterns 70 and 72 of FIG. 5, the gun side pattern 70 has narrower but longer rectangularly shaped elements than does the screen side pattern 72. The elements of both patterns overlap each other and a vertical space is left between the elements where the full thickness webs are to be located. In the patterns 74 and 76 of FIG. 6, the space left at the intended web locations is alternately omitted so that a rectanguarly shaped element of one pattern overlaps the web gap in the other pattern. In the patterns 78 and 80 of FIG. 7, the screen side pattern 80 is the same as the screen side pattern 72 of FIG. 5. The gun side pattern 78, however, is the same as the gun side pattern 76 of FIG. 6 with the gun side elements overlapping every other web gap in the screen side pattern.

The foregoing improved masks reduce the cross-sectional area of at least the alternate webs by at least 50 percent. The increases electron beam transmission of the masks without having to change slit width. Further, there is no degradation of purity caused by web lcations that might increase moiré. The elimination of the gun side portion of alternate webs eliminates the shadowing effect of the curved ends of the slit apertures at the alternate webs thereby even increasing the electron beam transmission at and near the tube center. Furthermore, the elimination of the gun side portion of alternate webs reduces the variable effect that slit end rounding has on measuring mask transmission for the purpose of determining average slit width. Such reduction increases the accuracy of the correlation between mask transmission and slit width. The mask 50 of FIG. 3 has still another advantage in mask construction. The prior art mask 40 of FIG. 2 as well as the improved mask 60 of FIG. 4 both require accurate vertical registration of the two photomaster patterns used to make them or the full thickness apertures will be formed in an offset manner that will cause decreased mask transmission. Of course, in the mask 60 of FIG. 4 this decrease in transmission would only be half the decreased noted in the prior art mask 40 of FIG. 2. The transmission of the mask 50 of FIG. 3, however, is unaffected by vertical misregister of the photomaster pattern with the possible exception of a slight affect on moiré.

What is claimed is:

1. In a color picture tube having a cathodoluminescent screen, an electron gun, and a slit type apertured mask located between the screen and gun, wherein the slits in said mask are arranged in vertical columns and the slits in each column are vertically separated by webs, the improvement comprising alternate webs within a column being of lesser thickness than the general mask thickness with the geometric center of the alternate webs being offset toward the screen side of the mask.

2. The tube as defined in claim 1 wherein the remaining webs within a column are of thickness equal to the general mask thickness.

3. The tube as defined in claim 1 wherein the remaining webs within a column are of lesser thickness than the general mask thickness with the geometric center of the remaining webs being offset toward the gun side of the mask.

4. The tube as defined in claim 1 wherein the alternate webs in one column are vertically offset from the alternate webs in adjacent columns.

* * * * *